US010308323B2

(12) United States Patent
Skyba et al.

(10) Patent No.: US 10,308,323 B2
(45) Date of Patent: Jun. 4, 2019

(54) RECONFIGURABLE ANCHOR SYSTEM FOR WATERCRAFT

(71) Applicant: Helmut K. Skyba, Wild Rose, WI (US)

(72) Inventors: Helmut Kurt Skyba, Wild Rose, WI (US); Wesley P. Pence, Newport, KY (US)

(73) Assignee: Helmut K. Skyba, Wild Rose, WI (US)

( * ) Notice: Subject to any disclaimer, the term of this patent is extended or adjusted under 35 U.S.C. 154(b) by 0 days.

(21) Appl. No.: 15/714,310

(22) Filed: Sep. 25, 2017

(65) Prior Publication Data

US 2019/0092430 A1 Mar. 28, 2019

(51) Int. Cl.
*B63B 21/24* (2006.01)
*B63B 21/32* (2006.01)

(52) U.S. Cl.
CPC ..... *B63B 21/243* (2013.01); *B63B 21/32* (2013.01)

(58) Field of Classification Search
CPC ..... B63B 21/24; B63B 21/26; B63B 21/30; B63B 21/32; B63B 21/34; B63B 21/46
USPC ..... 114/294, 299, 300, 301, 303
See application file for complete search history.

(56) References Cited

U.S. PATENT DOCUMENTS 1,494,545 A * 5/1924 Holzapfel ..... B63B 21/243 114/301
1,613,107 A * 1/1927 Holzapfel ..... B63B 21/32 114/301
1,617,528 A * 2/1927 Kucher ..... B63B 21/32 114/300
2,111,443 A * 3/1938 Windle ..... B63B 21/32 114/300
3,742,891 A * 7/1973 Diorio ..... B63B 21/40 114/300
4,403,564 A * 9/1983 Garvin ..... B63B 21/46 114/299
5,353,731 A * 10/1994 Richter ..... B63B 21/46 114/299

* cited by examiner

*Primary Examiner* — Lars A Olson
(74) *Attorney, Agent, or Firm* — McAndrews, Held & Malloy, Ltd.

(57) ABSTRACT

An anchor system for watercraft includes: a hub including a receiving contour; a skirt removably securable to the hub along a receiving contour of the hub, wherein: the skirt at least partially surrounds an inner recess and includes a gap such that such that the skirt is not circumferentially continuous; and the skirt is configurable in an open position and a closed position, wherein when the skirt is in the open position the gap is wider than when the skirt is in the closed position. The inner recess of the skirt has a radius that is larger than a complementary radius of the receiving contour of the hub when the skirt is in the open position. When in the closed position, the radiuses are substantially the same, such that the skirt is secured to the hub when the skirt is in the closed position.

16 Claims, 5 Drawing Sheets

RECONFIGURABLE ANCHOR SYSTEM FOR WATERCRAFT

CROSS REFERENCE TO RELATE APPLICATIONS

[Not Applicable]

BACKGROUND

Generally, this application relates to anchors for watercraft. Existing anchors may be designed for use in one or several specific types of sea bottom types and characteristics. Existing anchors may be either very heavy, causing them to be difficult and cumbersome to handle, or they may be of limited usefulness in one or more types of bottom soil composition and characteristics (e.g., sand, clay, stone, gravel, silt, or the like). In the case that a very heavy anchor is not used, multiple anchors may be required to operate anchor a boat in bodies of water with different types of bottoms.

SUMMARY

According to certain inventive techniques, an anchor system for watercraft may include: a hub including a receiving contour; a skirt removably securable to the hub along a receiving contour of the hub, wherein: the skirt at least partially surrounds an inner recess and includes a gap such that such that the skirt is not circumferentially continuous; and the skirt is configurable in an open position and a closed position, wherein when the skirt is in the open position the gap is wider than when the skirt is in the closed position; and an adjustment mechanism (e.g., a mating bolt and nut) attached to the skirt, wherein the adjustment mechanism is configured to selectively place the skirt into the open position or the closed position; and wherein: the inner recess of the skirt includes a radius that is larger than a radius of the receiving contour of the hub when the skirt is in the open position; and the radius of the inner recess of the skirt is substantially the same as the radius of the receiving contour of the hub when the skirt is in the closed position, such that the skirt is secured to the hub when the skirt is in the closed position. The skirt may have a plurality of flukes. The adjustment mechanism further may include two apertures in the skirt sized to receive a bolt, wherein the two apertures are located on opposite sides of the gap in the skirt. The skirt may have a substantially frustoconical shape having a vertical sloping angle, wherein the vertical sloping angle (e.g., 60 degrees) is steeper when the skirt is in the closed position and shallower when the skirt is in the open position. The system may include an additional skirt which has a shape that is different from the skirt. The skirt may be formed from a single piece of sheet metal; and the additional skirt may be formed from a single piece of sheet metal. The receiving contour of the hub may include a circumferential groove in the hub. The inner recess of the skirt includes may include a radius that is 20 percent larger than the radius of the receiving contour of the hub when the skirt is in the open position.

According to certain inventive techniques, a method for forming a portion of an anchor may include: stamping a piece of sheet metal using a first die to form a skirt, wherein: the skirt defines an inner recess; and there is a gap in the skirt such that the skirt is not circumferentially continuous. The method may further include crimping the skirt using a second die. The method may further include: creating a first aperture in the skirt proximate a first edge of the gap; and creating a second aperture in the skirt proximate a second edge of the gap, wherein the second edge of the gap is opposite the first edge of the gap, wherein each of the first aperture and the second aperture is sized to receive a bolt useable to secure the skirt. The method may further include: bending upwardly a portion of the skirt including the first aperture; and bending upwardly a portion of the skirt including the second aperture, wherein, after said bending steps, the first aperture and the second aperture are substantially aligned to receive the bolt. The first die may include a plurality of flanges such that, once stamped, the skirt includes a plurality of flukes. The first die may include only a single flange such that, once stamped, the skirt includes only a single fluke.

According to certain inventive techniques, an anchor system for watercraft may include: a hub; and a skirt including at least one fluke and configured to removably attach to the hub, wherein a primary thickness of the at least one fluke is less than 0.25". The hub may have a primary axial dimension. A tip of the at least one fluke may define an angle with respect to the primary axial dimension when the skirt is attached to the hub; the angle may be approximately 60 degrees. The anchor system may include an additional skirt configured to removably attach to the hub, wherein: the additional skirt comprises an additional at least one fluke; a shape of the additional at least one fluke is different from a shape of the at least one fluke. The skirt may include a plurality of flukes; and the additional skirt may have only one fluke.

Figure 1:
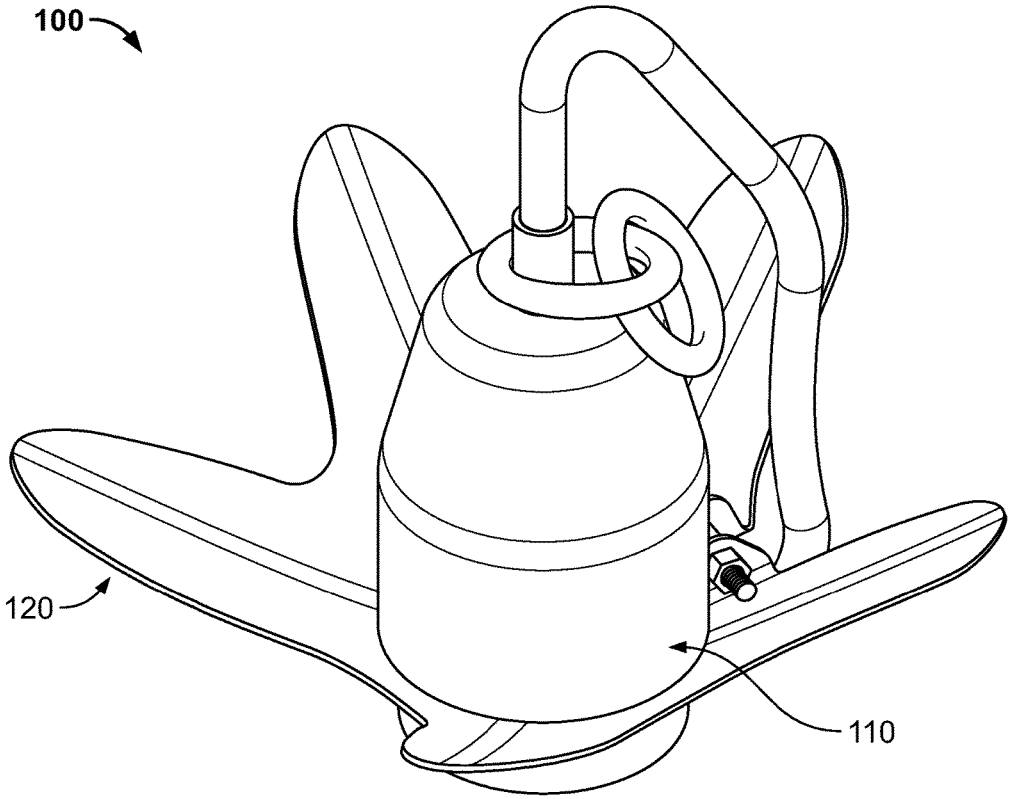
FIG. 1 illustrates an anchor system, according to certain inventive techniques.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIGS. 1, 2A, 2B, 3, 4A, and 4B illustrate various inventive techniques relating to an anchor system 100. As shown in FIG. 1, the anchor system 100 may include a hub 110 and skirt 120. Inventive techniques disclosed herein employ interchangeable skirts (e.g., skirt 120 depicted in FIG. 2A or skirt 130 depicted in FIG. 3) each removably attachable to a hub 110 (e.g., an anchor barrel). Each skirt may have differently formed flukes, which can effectively engage in different types of bottom surfaces in a body of water. Thus, the inventive anchor system 100 may be usable for different types of bottom surfaces without the need for different anchors.

Figure 2A:
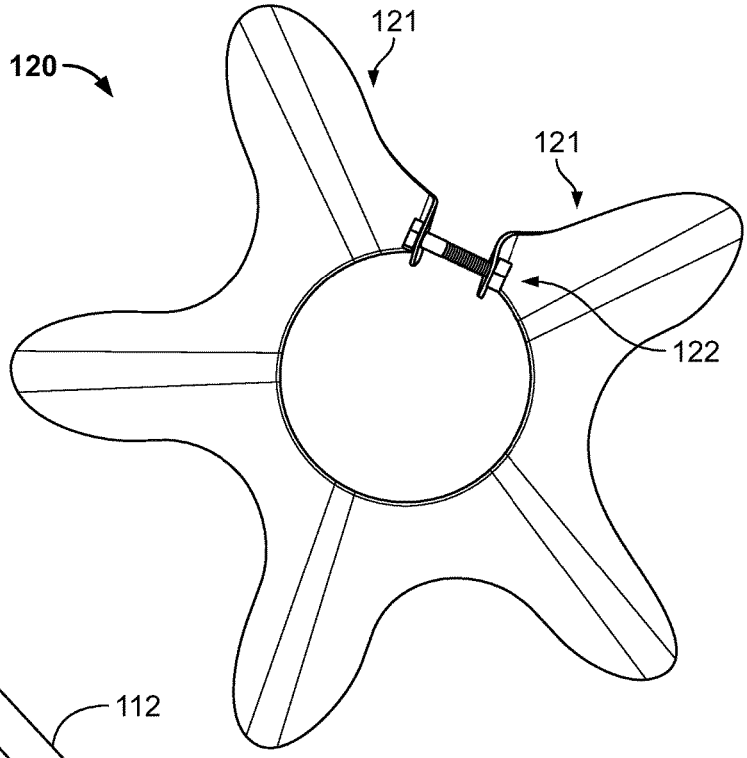
FIG. 2A illustrates a skirt for an anchor system, according to certain inventive techniques.
Figure 2B:
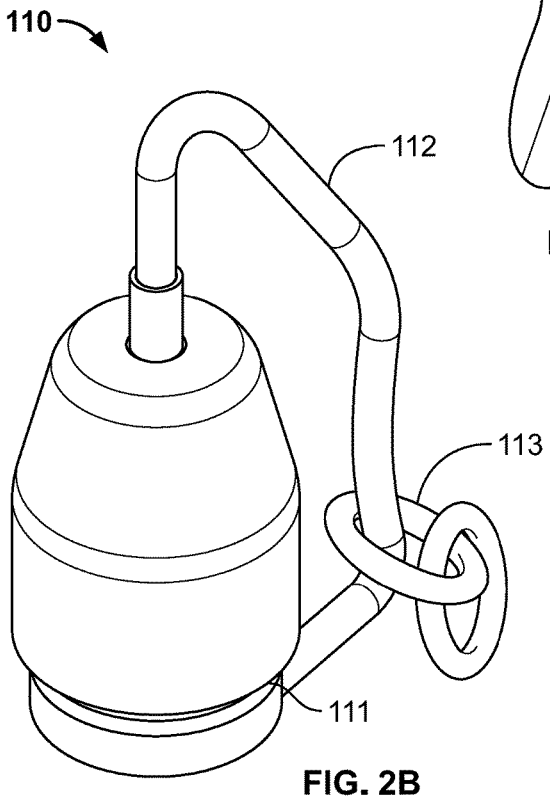
FIG. 2B illustrates a hub for an anchor system, according to certain inventive techniques.

The hub 110, depicted by itself in FIG. 2B, may be relatively heavy, for example between 2 and at least 15 pounds (depending on the size of the boat). The hub 110 may be constructed from, for example, cast iron (e.g., vinyl coated). The hub 110 may include a receiving contour 111 and a rod 112. Furthermore portion(s) of a chain 113 may be attached to the rod 112. The rod 112 and/or chain portion(s) 113 may facilitate connecting the hub 110 to an anchor line (not shown).

The receiving contour 111 in the hub 110 may receive the skirt(s) 120, 130 as further described below. The receiving contour 111 may be a circumferential groove, as depicted. The groove may be approximately ⅛" deep and/or wide. Alternatively, the receiving contour 111 need not be continuously circumferential, and/or need not be circumferentially oriented. For example, the receiving contour 111 may include a plurality of vertical and/or horizontal recesses that complement and receive corresponding protrusions in the skirt(s) 120, 130.

The skirt 120, depicted by itself in FIG. 2A, has an inner contour that defines an inner recess. The inner contour of the skirt 120 may be complementary to the receiving contour 111 of the hub 110. The inner recess may not be completely enclosed. Specifically, there may be a gap in the skirt 120, such that the skirt 120 is not circumferentially continuous. The skirt 120 may include one or a plurality of flukes 121. As depicted, skirt 120 includes five flukes 121. The flukes 121 may be configured to engage in a bottom surface of an aquatic environment. Different skirts may have differently shaped or a different number of flukes 121 depending on the type of bottom surface to be expected.

The skirt 120 may be formed from a single flat sheet of metal (e.g., 12 gauge stainless steel). According to some inventive techniques, while the skirt 120 may be tapered or crimped at the edges, the primary thickness of the skirt 120 may be less than ¼" (e.g., approximately 7⁄64"). The flukes 121 may be bent to form upwardly facing concavities, as depicted. Tough organic plastics may also be employed. Examples are thermoplastic olefins such as polypropylene, or polycarbonates, polyesters, polyurethanes or polyamides. Reinforcing fibers such as fiberglass, carbon, etc. may be added to increase toughness and durability.

The skirt 120 may have a gap, the size of which may be adjusted by an adjustment mechanism 122. Thus, the skirt may not be circumferentially continuous. By adjusting the size of the gap, the skirt 120 may be placed in an open or closed position. The skirt 120 may be placed in a closed position even if the gap is not entirely eliminated. Instead, a suitable reduction in the gap size (as further discussed below) will cause the skirt 120 to be placed into a closed position.

When the skirt 120 is in the open position, the inner contour of the skirt 120 around the interior recess may be relatively large, thereby allowing a user to remove or orient the skirt 120 with respect to the hub 110. In the open position, a radius of the inner recess may be larger than a complementary radius of the receiving contour 111 of the hub 110 (e.g., approximately 20% larger). Once suitably positioned on the hub 110, the skirt 120 may be placed in the closed position. In the closed position, the inner contour of the skirt 120 around the interior recess may be smaller than when the skirt is in the open position. For example, a radius of the inner recess may be larger when the skirt 120 is in the open position than when it is in the closed position. As the contour around the interior recess of the skirt 120 reduces, it abuts the complementary receiving contour 111 on the hub 110. In this arrangement, the radius of the inner recess of the skirt may be substantially the same as a corresponding complementary radius in the hub 110. Eventually, sufficient pressure is formed between the complementary contours and the skirt 120 becomes removably attached to the hub 110.

The adjustment mechanism 122 may be (removably) attached to the skirt 120. The adjustment mechanism may be configured to adjust the size of the gap in the skirt 120, thereby selectively placing the skirt 120 in the open or closed position. The adjustment mechanism 122 may include a nut and bolt, as shown. The bolt may be arranged to go through two apertures on opposite sides of the gap. In this arrangement, portions of the skirt 120 on the opposite side of the gap that include the holes may be bent upwardly (e.g., approximately perpendicular to the remainder of the skirt 120). The holes may substantially align such that each hole can receive the bolt at the same time. By tightening the nut, the two sides of the gap may be drawn towards each other. Similarly, by loosening the nut, the gap may expand due to the material memory of the skirt (e.g., stainless steel).

Figure 4A:
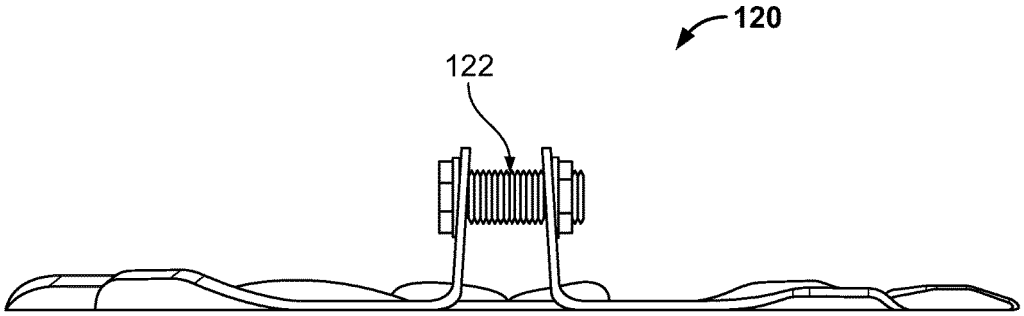
FIGS. 4A and 4B illustrate an elevational view of a skirt for an anchor system in an open and closed position, respectively, according to certain inventive techniques.
Figure 4B:
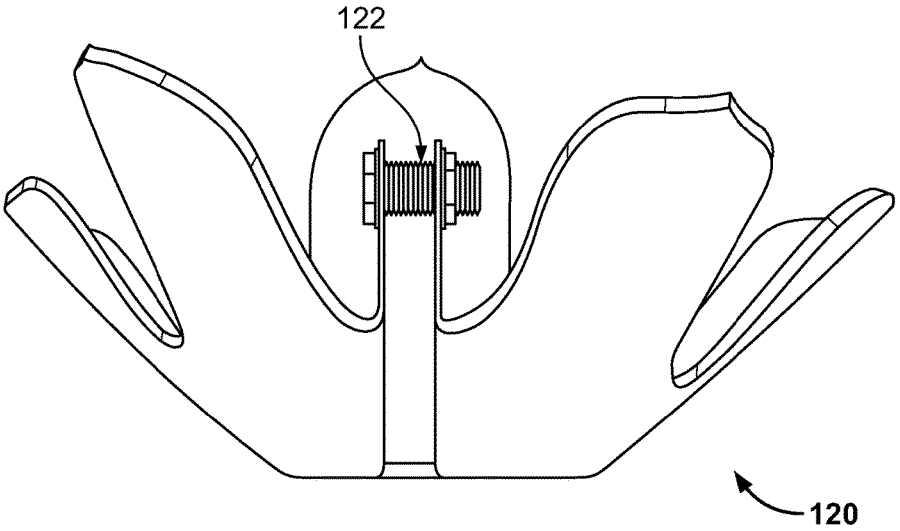

As shown in FIGS. 4A and 4B, the skirt 120 may be basically flat when it is in the open position (FIG. 4A), and in a frustoconical shape when it is in the closed position (FIG. 4B). When in the closed position, the skirt 120 may have a steeper vertical sloping angle than when in the open position. Such an angle may be approximately 60 degrees when the skirt 120 is in the closed position.

Figure 3:
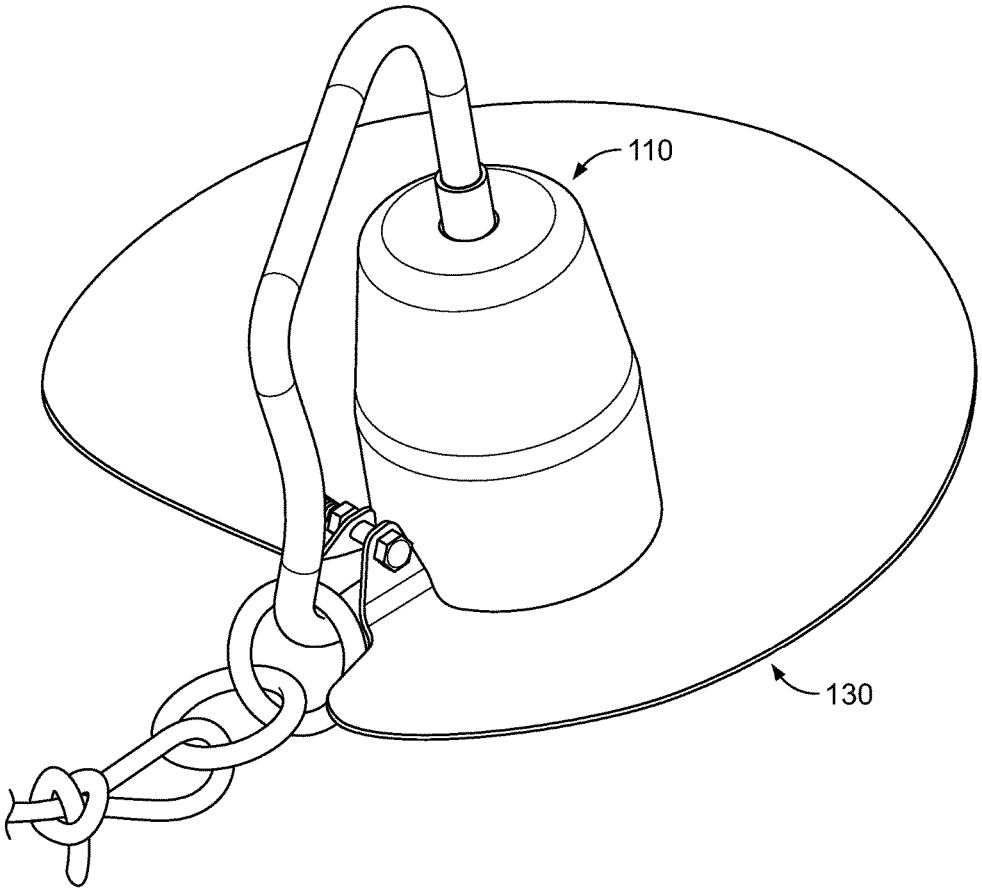
FIG. 3 illustrates an anchor system, according to certain inventive techniques.

FIG. 3 depicts an additional skirt 130 that may be used with the anchor system 100. The additional skirt 130 may be materially similar to the skirt 120, and the same teachings apply. However, the additional skirt 130 may include a shape different from that of the skirt 120. As depicted, the additional skirt 130 may have only one fluke. Various additional skirts may be usable with the anchor system 100. Each skirt may be adapted to engage with a different type of bottom surface in a marine environment. For example, skirt 120 may be useful for engaging a variety of bottom surfaces, while skirt 130 may be useful for engaging marl or relatively soft bottom surfaces.

Figure 5:
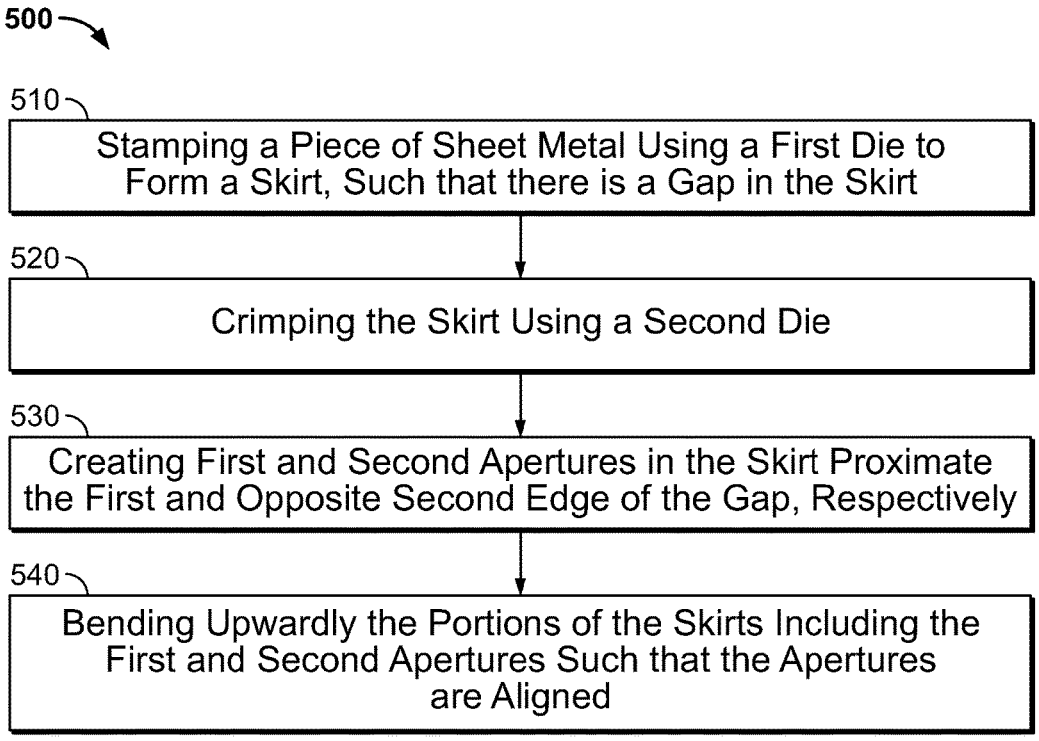
FIG. 5 illustrates a flow chart for a method of forming a skirt for an anchor system, according to certain inventive techniques.

FIG. 5 illustrates a flowchart 500 for a method of forming a portion of an anchor—specifically, a skirt such as skirt 120 or 130. The steps may be performed in a different order, as may be the case, or overlapping in time. At step 510, a piece of sheet metal (e.g., 12-gauge stainless steel) may be stamped using a first die to form a skirt. A gap may be formed in the skirt. The skirt may be basically flat at this stage. The first die may include a plurality of flanges such that, once stamped, the skirt includes a plurality of flukes. Alternatively, the first die may have only a single flange, such that, once stamped, the skirt has only a single fluke. At step 520, the skirt may be crimped using a second die. This may give each of the fluke(s) of the skirt concav(ities) as depicted in FIGS. 1, 2A, 4A, and 4B, and discussed above. At step 530, first and second apertures in the skirt are created proximate first and opposite second edges of the gap, respectively. Apertures may be formed as part of the stamping and/or crimping process, or they may be drilled at some time during the manufacturing process. At step 540, the portions of the skirts that include (or will include) the first and second apertures may be bent upwardly, such that the apertures are substantially aligned.

The inventive techniques resolve various problems through the use of interchangeable skirts for an anchor hub. Each attachment may have differently formed flukes, which may effectively engage in a wide variety of seabed substrate. The inventive techniques allow for anchors that are less costly and smaller, because there is no need to have multiple anchors—e.g., the same hub is used with each different skirt.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. An anchor system for watercraft, comprising:

a hub including a receiving contour;

a skirt removably securable to the hub along the receiving contour of the hub, wherein:

the skirt at least partially surrounds an inner recess and includes a gap such that such that the skirt is not circumferentially continuous; and the skirt is configurable in an open position and a closed position, wherein when the skirt is in the open position the gap is wider than when the skirt is in the closed position; and an adjustment mechanism attached to the skirt, wherein the adjustment mechanism is configured to selectively place the skirt into the open position or the closed position; and wherein:

the inner recess of the skirt includes a radius that is larger than a complementary radius of the receiving contour of the hub when the skirt is in the open position; and the radius of the inner recess of the skirt is substantially the same as the complementary radius of the receiving contour of the hub when the skirt is in the closed position, such that the skirt is secured to the hub when the skirt is in the closed position.

2. The anchor system of claim 1, wherein the skirt comprises a plurality of flukes.

3. The anchor system of claim 1, wherein the adjustment mechanism comprises a mating bolt and nut.

4. The anchor system of claim 3, wherein the adjustment mechanism further comprises two apertures in the skirt sized to receive the bolt, wherein the two apertures are located on opposite sides of the gap in the skirt.

5. The anchor system of claim 1, wherein the skirt forms a substantially frustoconical shape having a vertical sloping angle, wherein the vertical sloping angle is steeper when the skirt is in the closed position and shallower when the skirt is in the open position.

6. The anchor system of claim 5, wherein the vertical sloping angle is approximately 60 degrees when the skirt is in the closed position.

7. The anchor system of claim 1, further comprising an additional skirt which has a shape that is different from the skirt.

8. The anchor system of claim 7, wherein:

the skirt is formed from a single piece of sheet metal; and the additional skirt is formed from a single piece of sheet metal.

9. The anchor system of claim 1, wherein the receiving contour of the hub comprises a circumferential groove in the hub.

10. The anchor system of claim 1, wherein the inner recess of the skirt includes a radius that is 20 percent larger than the complementary radius of the receiving contour of the hub when the skirt is in the open position.

11. A method for forming a portion of an anchor comprising:

stamping a piece of sheet metal using a first die to form a skirt, wherein:

the skirt defines an inner recess; and there is a gap in the skirt such that the skirt is not circumferentially continuous.

12. The method of claim 11, further comprising crimping the skirt using a second die.

13. The method of claim 11, further comprising:

creating a first aperture in the skirt proximate a first edge of the gap; and creating a second aperture in the skirt proximate a second edge of the gap, wherein the second edge of the gap is opposite the first edge of the gap, wherein each of the first aperture and the second aperture is sized to receive a bolt useable to secure the skirt.

14. The method of claim 13, further comprising:

bending upwardly a portion of the skirt including the first aperture; and bending upwardly a portion of the skirt including the second aperture, wherein, after said bending steps, the first aperture and the second aperture are substantially aligned to receive the bolt.

15. The method of claim 11, wherein the first die comprises a plurality of flanges such that, once stamped, the skirt includes a plurality of flukes.

16. The method of claim 11, wherein the first die comprises only a single flange such that, once stamped, the skirt includes only a single fluke.

* * * * *